US005544428A

United States Patent [19]

Kuroda et al.

[11] Patent Number: 5,544,428

[45] Date of Patent: Aug. 13, 1996

[54] CLOTHES DRIER WITH DRYING TERMINATION DETERMINING FUNCTION

[75] Inventors: Koichi Kuroda, Shiga; Yoshiaki Aoki, Otsu; Kiyokazu Fujikawa; Youzon Kawamura, both of Shiga; Tatsuya Hirota, Kyoto; Tamotsu Kawamura, Yokaich; Takashi Fukuda; Minoru Kishi, both of Otsu; Hisanori Hirose, Shiga, all of Japan

[73] Assignee: Sanyo Electric Co., Ltd., Osaka, Japan

[21] Appl. No.: 415,318

[22] Filed: Apr. 3, 1995

[30] Foreign Application Priority Data

Apr. 27, 1994 [JP] Japan ..... 6-090151

[51] Int. Cl.[6] ..... F26B 3/00

[52] U.S. Cl. ..... 34/493; 34/491; 34/495

[58] Field of Search ..... 34/491, 493, 495, 34/533, 575

[56] References Cited

U.S. PATENT DOCUMENTS

| | | | |
|---|---|---|---|
| 3,229,379 | 1/1966 | Heidtmann | 34/533 |
| 3,583,688 | 6/1971 | Fuqua | 263/33 |
| 5,228,212 | 7/1993 | Turetta et al. | 34/27 |
| 5,347,727 | 9/1994 | Kim | 34/491 |

OTHER PUBLICATIONS

English abstract for Japanese Unexamined Patent Publication No. 1-134054.

English abstract for Japanese Unexamined Patent Publication No. 1-156242.

English abstract for Japanese Unexamined Patents Publication No. 1-138615.

*Primary Examiner*—Henry A. Bennett

*Assistant Examiner*—Dinnatia Doster

*Attorney, Agent, or Firm*—Beveridge, DeGrandi, Weilacher & Young, L.L.P.

[57] ABSTRACT

A clothes drier according to the present invention can minimize failures in a sensor and can satisfactorily detect drying processing irrespective of the environment. In the clothes drier, an atmospheric temperature sensor 44L for detecting the substrate temperature required to determine the termination of the drying processing is disposed outside a circulating duct 18 and is mounted on a control substrate 42 having a thermal capacity on which a microcomputer for controlling operations performed by the clothes drier is mounted. Since the sensor 44L is provided outside the circulating duct 18, the sensor 44L is less affected by dust and water, as compared with a case where it is provided inside the circulating duct 18.

6 Claims, 9 Drawing Sheets

CLOTHES DRIER WITH DRYING TERMINATION DETERMINING FUNCTION

BACKGROUND OF THE INVENTION

1. Field of the Invention

The present invention relates to a clothes drier for drying clothes contained in a rotating drum.

2. Description of the Prior Art

A clothes drier for supplying heated air to a rotating drum containing clothes as well as rotating the rotating drum to dry the clothes has been conventionally used. Such a clothes drier generally comprises a fan, and air in the clothes drier is circulated through a circulating duct connected to the rotating drum by the rotation of the fan. A heater is mounted in the vicinity of the entrance of the rotating drum. The air fed into the circulating duct is heated by the heater to form heated air, and the heated air formed is supplied to the rotating drum. In the rotating drum, heat is exchanged between the heated air supplied and the clothes, whereby water penetrating into the clothes is vaporized. Air containing water is exhausted from the rotating drum to the circulating duct, whereby the water contained in the air is cooled down and condensed to dehumidify the air by predetermined dehumidifying means. The dehumidified air is fed toward the entrance of the rotating drum again through the circulating duct by the rotation of the fan. The condensed water is drained outward from the clothes drier through a predetermined drain port.

In this type of clothes drier, the termination of drying processing is generally determined depending on whether or not the temperature difference between temperatures respectively detected by two temperature sensors reaches a predetermined temperature difference corresponding to the amount of clothes. Utilized as the above described two temperature sensors are a temperature sensor for detecting the temperature of the air exhausted from the rotating drum and a temperature sensor for detecting the room temperature. The temperature of the air exhausted from the rotating drum can be considered to be approximately the same as the temperature of the clothes in the rotating drum because heat is exchanged between the air and the clothes in the rotating drum. On the other hand, the room temperature is generally constant. When the temperature difference between the temperature of the air exhausted from the rotating drum and the room temperature reaches a predetermined temperature difference, it can be judged that the clothes are thoroughly dried.

The clothes drier is installed in a narrow room such as a bathroom in many cases. If the door of the bathroom is suddenly opened, for example, therefore, the temperature of the room may rapidly drop. Consequently, the temperature difference between the temperature of the air exhausted from the rotating drum and the room temperature rapidly reaches the predetermined temperature difference, whereby it is erroneously determined that drying processing is terminated, although it is not actually terminated.

DESCRIPTION OF THE RELATED ART

Examples of a technique for determining the termination of drying processing that is not affected by the environment include a technique for providing a temperature sensor for detecting the temperature of air before being heated by a heater inside a circulating duct on the upstream side of the heater and determining that drying processing is terminated when the temperature difference between the temperature detected by the temperature sensor and the temperature of air exhausted from a rotating drum reaches a predetermined temperature difference corresponding to the amount of clothes.

FIG. 9A is a diagram showing the change in the temperature of air exhausted from the rotating drum and the temperature of air before being heated by the heater with operating time, and FIG. 9B is a diagram showing the change in the temperature difference between the above described temperatures with operating time. As can be seen from FIGS. 9A and 9B, the change in the temperature difference is approximately the same as the change in the temperature of the air exhausted from the rotating drum. When the temperature difference reaches a predetermined temperature difference, therefore, it can be determined that the clothes are thoroughly dried.

Furthermore, the above described temperature sensor is provided in the circulating duct, whereby response to the change in the environment is slow. Therefore, even when the clothes drier is installed in a narrow room and the door of the narrow room is suddenly opened so that the temperature of the room rapidly changes, the detected temperature does not rapidly change. For the above mentioned reason, it is possible to satisfactorily determine the termination of the drying processing.

Since the absolute humidity is the highest (approximately 100%) inside the circulating duct. The absolute humidity in the circulating duct is lowered since the air in the circulating duct is dehumidified in the dehumidifying means. However, the relative humidity becomes higher in the cooled air, or the relative humidity is the highest in the cooler air during the period after being cooled and dehumidified by the dehumidifying means until being heated by the heating means in the circulating duct. As a result, the rate of occurrence of defects by failures and changes with years in the temperature sensor provided in the circulating duct is high. If the temperature sensor fails, the termination of the drying processing cannot be normally determined by the above described conventional control method, thereby to make it impossible to realize good drying.

SUMMARY OF THE INVENTION

Therefore, an object of the present invention is to solve the above described technical problems and to provide a clothes drier capable of minimizing failures in a temperature sensor as well as satisfactorily determining the termination of drying processing irrespective of the environment.

In order to attain the above described object, a clothes drier in accordance with one aspect of the present invention is characterized by comprising a rotating drum comprising an air inlet and an air outlet for containing clothes, circulating air duct means having its one end connected to the air outlet in the rotating drum and the other end connected to the air inlet in the rotating drum, heating means provided in the circulating air duct means for forming heated air, air blower means for circulating the heated air formed in the heating means in said circulating air duct means and said rotating drum, dehumidifying means for dehumidifying the heated air when it goes out of said rotating drum and goes through said circulating air duct means, first temperature detecting means for detecting the temperature of the heated air exhausted from the rotating drum, second temperature detecting means provided outside the circulating air duct means and in the position where the temperature of a member having a large thermal capacity can be detected for detecting the temperature of the member having a large thermal capacity, and determining means for determining whether or not drying processing is terminated on the basis of the temperature difference between temperatures respectively detected by the first temperature detecting means and the second temperature detecting means.

In the above described construction, the second temperature detecting means used for determining the temperature of the drying processing is provided outside the circulating air duct means. Accordingly, it is possible to minimize failures occurring in the second temperature detecting means due to the effect of water and dust, as compared with a case where the second temperature detecting means is provided inside the circulating air duct means which is greatly affected by water and dust. Moreover, the temperature of the member having a large thermal capacity is detected. Even if the environment rapidly changes, therefore, the detected temperature does not rapidly change. Therefore, it is possible to satisfactorily determine the termination of the drying processing irrespective of the environment.

In accordance with another aspect, the present invention is characterized in that the member having a large thermal capacity is a control substrate, and the second temperature detecting means and the determining means are disposed on the control substrate.

If the second temperature detecting means and the determining means are provided on the same control substrate as in the above described construction, it is possible to reduce the length of a signal line to connect the second temperature detecting means and the determining means as well as simplify wiring work. In addition, it is possible to reduce the cost.

In the above described construction, it is possible to simplify the construction when the air blower means is made to be the heat-exchange type air blower means combined with the function of the dehumidifying means.

In accordance with still another aspect, the present invention is characterized by further comprising judging means for judging whether or not the change with time in the temperature difference between the temperatures respectively detected by the first temperature detecting means and the second temperature detecting means is the minimum, the above described determining means determining that the drying processing is terminated when the temperature difference reaches a value obtained by adding a predetermined temperature to a temperature difference in a case where the judging means judges that the change with time in the temperature difference is the minimum.

If the present invention is thus constructed, the temperature difference which forms a basis required to determine the termination of the drying processing is found depending on whether or not the change with time is the minimum, thereby to make it possible to find an always stable temperature difference which forms a basis. Accordingly, it is possible to determine the termination of the drying processing more accurately.

Furthermore, it is preferable that the above described second temperature detecting means is sealed by a predetermined cover. The reason for this is that the termination of the drying processing can be prevented from being erroneously determined, and the failures can be minimized.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
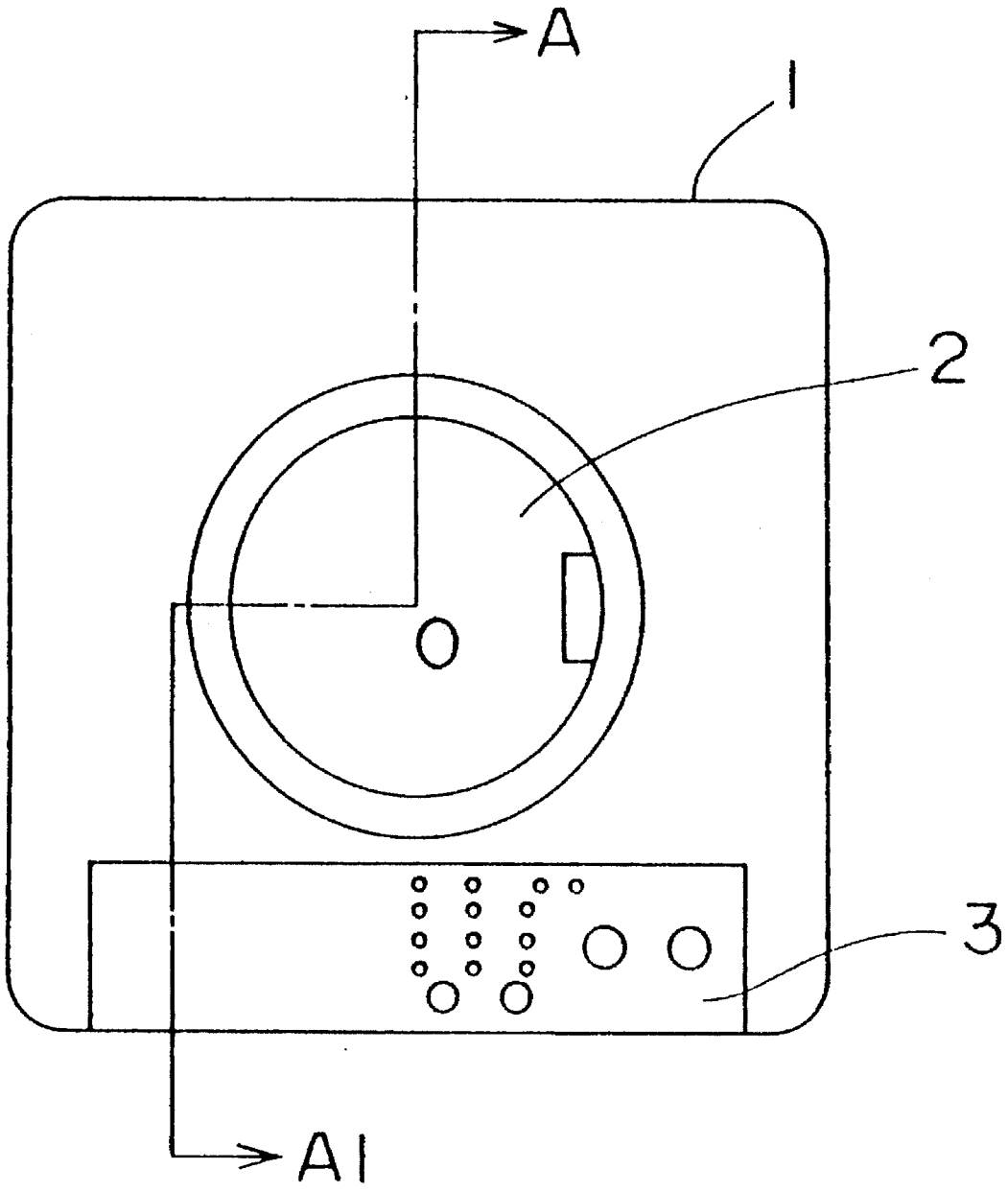
FIG. 1 is a front view showing the construction of a clothes drier according to a first embodiment of the present invention.

FIG. 1 is a front view showing the schematic construction of a clothes drier according to one embodiment of the present invention. A door 2 for throwing clothes in the clothes drier is mounted on the center of a front surface of a drier body 1 so that it can be freely opened or closed. In addition, a control plate 3 comprising a start key and the like as described later is mounted on the bottom of the front surface of the drier body 1.

Figure 2:
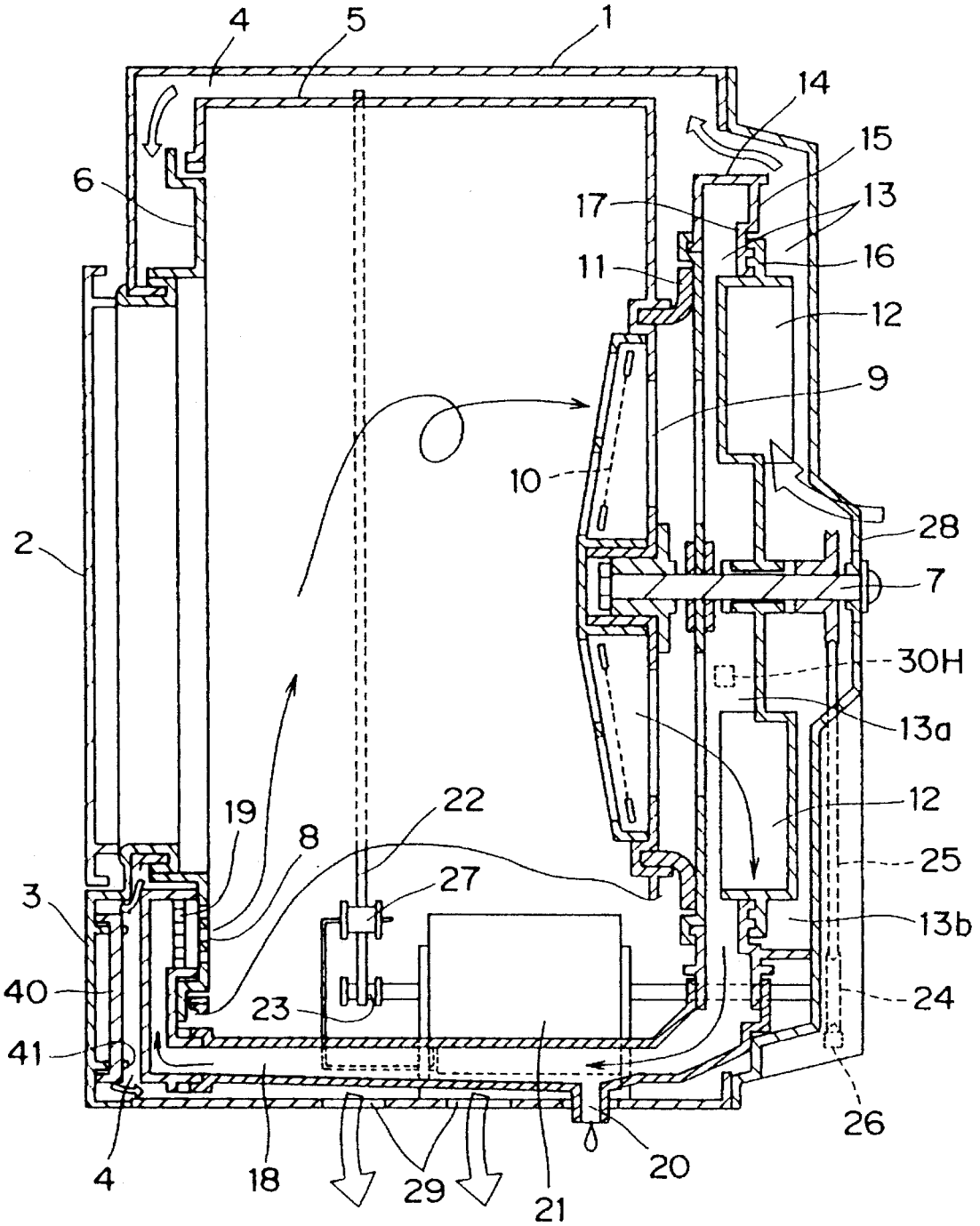
FIG. 2 is a cross sectional view taken along a line A–O–A1 shown in FIG. 1.

FIG. 2 is a cross sectional view taken along a line A–O–A1 shown in FIG. 1. A drying chamber 4 is formed inside the drier body 1, and a rotating drum 5 for containing clothes is mounted inside the drying chamber 4.

The rotating drum 5 on the side of its front surface is rotatably supported on the drier body 1 through a felt or the like (not shown) by a drum supporting plate 6 made of an annular sheet metal which is mounted so as to enclose the door 2. In addition, the rotating drum 5 on the side of its rear surface is rotatably supported on the drier body 1 by a shaft 7. Further, an air inlet 8 for entrapping heated air as described later is formed in a lower part of the front surface of the rotating drum 5. In addition, an air outlet 9 is formed in the vicinity of the center of the rear surface of the rotating drum 5, and the air outlet 9 is covered with a lint filter 10. Reference numeral 11 denotes a sealing member for sealing a portion between the drying chamber 4 and a fan chamber as described later in order that air exhausted through the air outlet 9 does not to enter the drying chamber 4.

A fan chamber 13 containing a heat-exchange type double-sided fan 12 fixed to the shaft 7 is partitioned by a fan casing 14 behind the rotating drum 5. The double-sided fan 12 functions as air blower means as well as dehumidifying means for circulating air in the drier body 1 as well as removing water from the air being circulated, as described in detail later. The fan casing 14 is provided with a partitioning plate 15 made of synthetic resin so as to enclose the double-sided fan 12. The double-sided fan 12 is contained in a circular opening in the center of the partitioning plate 15, whereby an inner space of the fan chamber 13 is partitioned into a dry air duct 13*a* and a cold air duct 13*b*. The cold air duct 13*b* is connected to the drying chamber 4 in the upper part of the drier body 1.

A group of rotating grooves 16 in a concentric circle shape depressed toward the dry air duct 13*a* is integrally formed in a peripheral edge of the double-sided fan 12. The group of rotating grooves 16 is loosely fitted in a group of fixed grooves 17 integrally formed in above described partitioning plate 15. That is, the group of rotating grooves 16 and the group of fixed grooves 17 constitute a labyrinth bond. Therefore, air cannot reciprocate between the dry air duct 13*a* and the cold air duct 13*b*.

A circulating duct 18 is provided in the lower part of the drier body 1. The circulating duct 18 connects the dry air duct 13*a* and the air inlet 8, and a heater 19 functioning as heating means is disposed in the vicinity of the air inlet 8. In addition, a drain port 20 for draining condensed water as described later out of the drier body 1 is formed in a lowermost part of the circulating duct 18. In the present embodiment, the circulating duct 18 and the dry air duct 13*a* correspond to circulating air duct means.

A motor 21 is provided on the bottom of the drier body 1. The motor 21 transmits torque to a belt 22 wound around an outer peripheral surface of the rotating drum 5 through a pulley 23, while transmitting torque to the double-sided fan 12 through a pulley 24 and a belt 25. As a result, the rotating drum 5 and the double-sided fan 12 are rotated by the motor 21. A sensor 26 for detecting the number of revolutions of the motor 21 is mounted on the pulley 24. An idler pulley 27 prevents the belt 22 from slipping with respect to the rotating drum 5 by applying tension to the belt 22 when the rotating drum 5 is rotated.

If the double-sided fan 12 is rotated, air is fed into the circulating duct 18 from the dry air duct 13*a*. The air fed into the circulating duct 18 is heated by the heater 19 becoming be heated air, and the heated air is supplied to the rotating drum 5 through the air inlet 8. In the rotating drum 5, heat is exchanged between the heated air supplied and clothes. As a result, water contained in the clothes is vaporized. The air containing water is fed into the dry air duct 13*a* again by the rotation of the double-sided fan 12. That is, the air circulates through the dry air duct 13*a*, the circulating duct 18 and the rotating drum 5 by the rotation of the double-sided fan 12.

Additionally, if the double-sided fan 12 is rotated, outside air is entrapped in the cold air duct 13*b* through an outside air inlet 28 formed in the center of the rear surface of the drier body 1. At this time, the double-sided fan 12 is cooled by the outside air. The entrapped outside air is exhausted through an outside air outlet 29 formed in the lower part of the drier body 1 after Passing through the drying chamber 4 from the cold air duct 13*b*.

The air in the dry air duct 13*a* is cooled when it comes into contact with the double-sided fan 12. That is, the air in the dry air duct 13*a* is cooled by the contact with the double-sided fan 12 because the double-sided fan 12 is cooled by the outside air. The air in the dry air duct 13*a* is humid hot air exhausted from the rotating drum 5. This air is cooled, and water in the air is condensed to dehumidify the air. The dehumidified air is supplied to the circulating duct 18 again by the rotation of the double-sided fan 12. The condensed water flows downward through the dry air duct 13*a*, and is drained through the drain port 20.

In this embodiment, the heat-exchange type air-supplying fan 12 for both air blower means and dehumidifying means is adopted, but it is also possible to separately provide the air-blower means and the dehumidifying means for dehumidifying the air.

An outlet temperature sensor 30H for detecting the temperature of the air exhausted from the rotating drum 5 is disposed in the vicinity of the air outlet 9 of the rotating drum 5. The outlet temperature sensor 30H is constituted by a thermal element such as a thermistor. In the present embodiment, the outlet temperature sensor 30H corresponds to first temperature detecting means.

A substrate case 40 made of synthetic resin is mounted by machine screws 41 inside the drying chamber 4 in the lower part of the drier body 1 and behind the control plate 3 (see FIG. 1).

Figure 3A:
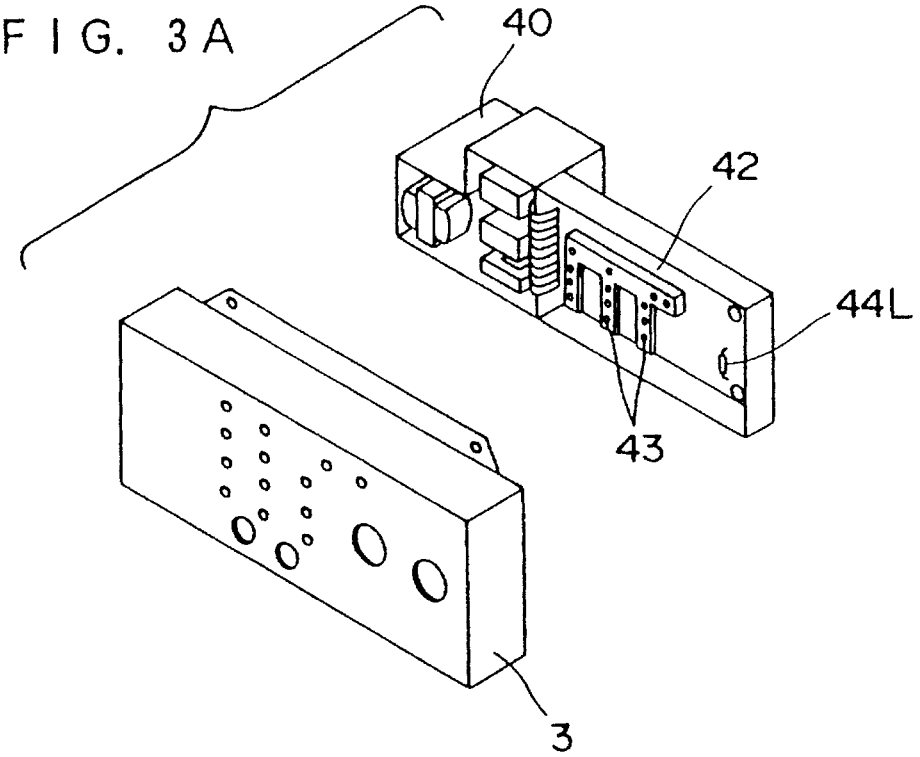
FIGS. 3A and 3B are diagrams for explaining portions related to a substrate case constituting a part of the clothes drier.
Figure 3B:
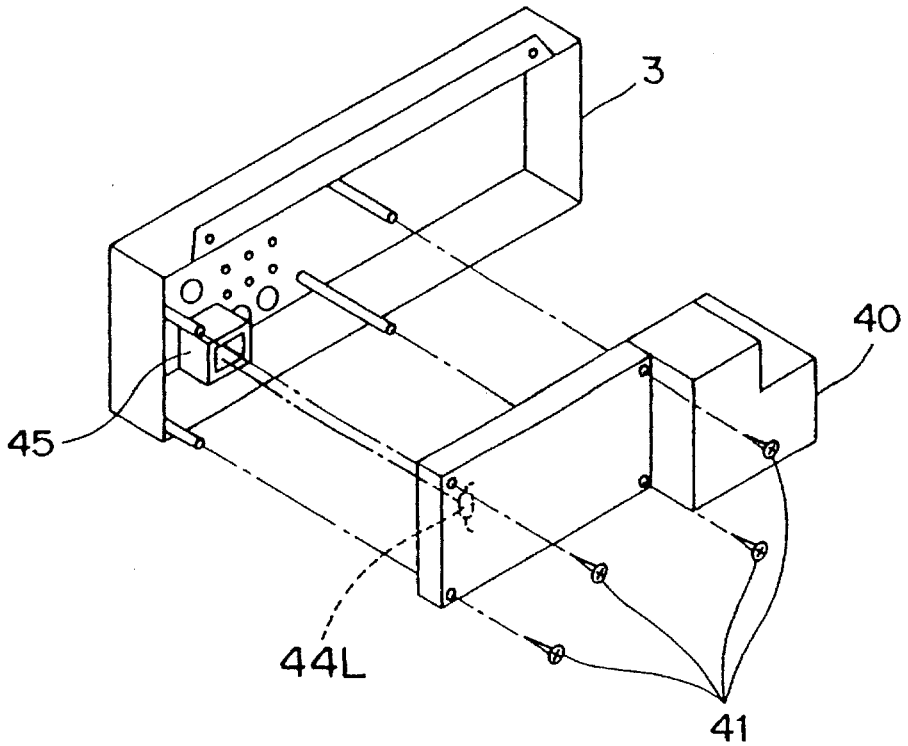

FIGS. 3A and 3B are perspective view for explaining portions related to the above described substrate case 40. A control substrate 42 is mounted on the substrate case 40, as shown in FIG. 3A. The control substrate 42 is composed of a member having a large thermal capacity which is not easily affected by the ambient temperature. Specifically, the control substrate 42 is composed of paper phenol resin or glass epoxy resin. A display device 43 for lighting a microcomputer as described later and a display as described later, an atmospheric temperature sensor 44L functioning as second temperature detecting means, and the like are mounted on the control substrate 42, and the upper surface thereof is coated with urethane. The atmospheric temperature sensor 44L is composed of a thermal element such as a thermistor for detecting the substrate temperature of the control substrate 42.

The atmospheric temperature sensor 44L is covered with a cover 45 integrally formed in the control plate 3, as shown in FIG. 3B. The cover 45 prevents cooled air fed into the drying chamber 4 and heated air leaking out of the rotating drum 5 through a felt from directly striking the atmospheric temperature sensor 44L. Accordingly, the atmospheric temperature sensor 44L does not erroneously detect the substrate temperature by the temperature of the cooled air and the heated air. The heated air supplied to the rotating drum 5 is generally fed into the dry air duct 13*a* from the air outlet 9 through the lint filter 10. Particularly when the lint filter 10 is clogged, however, the heated air may, in some cases, leak out to the drying chamber 4 through the felt. If the heated air leaking out, for example, directly strikes the atmospheric temperature sensor 44L, the temperature is erroneously detected. The cover 45 prevents the temperature from being erroneously detected.

Figure 4:
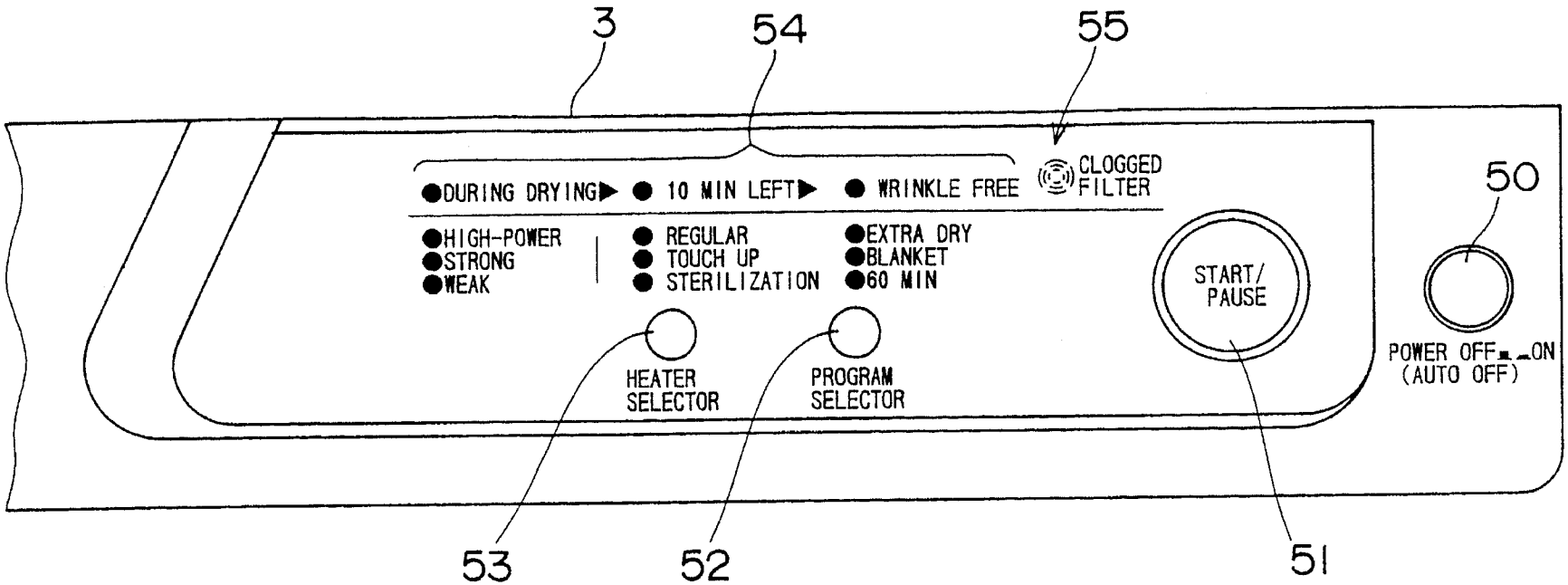
FIG. 4 is a front view showing a control plate, a part of which is omitted constituting a part of the clothes drier.

FIG. 4 is a front view showing the control plate 3, a part of which is omitted provided in the above described clothes drier. The control plate 3 comprises a power switch 50 for turning the power supply on, a start/pause switch 51 for starting the drying operation or temporarily stopping the drying operation, and a program selector 52 for selecting a drying course such as a "standard course" or a "touch up drying course". In addition, the control plate 3 comprises a heater selector 53 for selecting the degree of heating of air in the heater 19, an LED (Light Emitting Diode) display 54 for informing a user how far the drying process has proceeded, and a clogged filter 55 for informing the user of the clogging of the lint filter 10.

Figure 5:
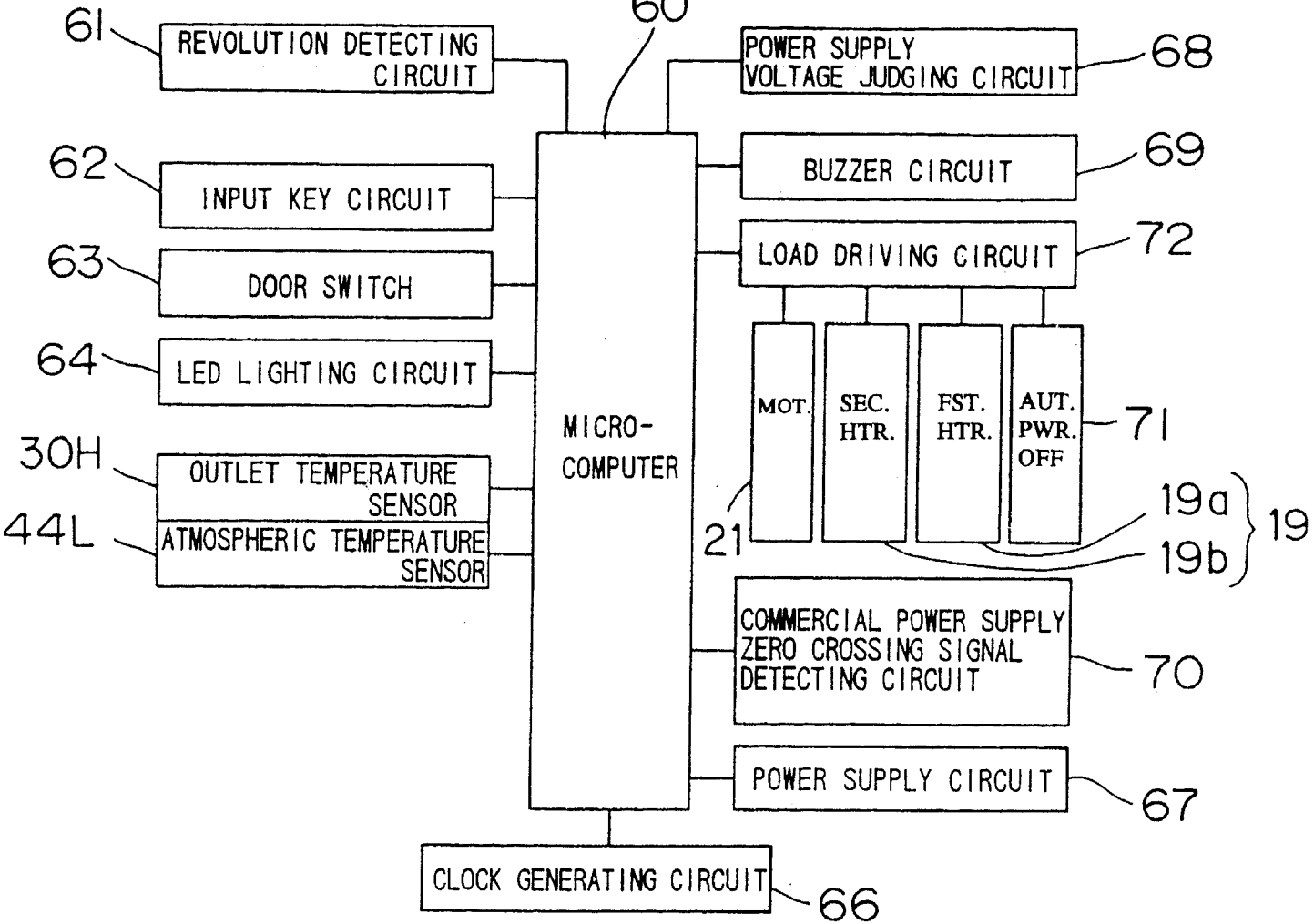
FIG. 5 is a block diagram showing the electrical construction of the clothes drier.

FIG. 5 is a block diagram showing the electrical construction of the above described clothes drier. The clothes drier comprises a microcomputer 60 for controlling the operations of respective portions in the clothes drier. The microcomputer 60 comprises a CPU, a ROM, a RAM and a timer which are not illustrated, for carrying out predetermined control in accordance of a program stored in the ROM. In the present embodiment, the microcomputer 60 functions as determining means, control means and judging means.

A revolution detecting circuit 61 to which the sensor 26 is connected, an input key circuit 62 to which the power switch 50, and start/pause switch 51 and the like are connected, a door switch 63 for detecting the opening and closing of the door 2, an LED lighting circuit 64 to which the LED display 54 and the sign display 55 are connected, and a clock generating circuit 66 for generating clocks are connected to the above described microcomputer 60.

Furthermore, a power supply circuit 67 connected to a commercial power supply, a power supply voltage judging circuit 68 for judging a voltage of the power supply circuit 67, a buzzer circuit 69 to which a buzzer for informing a user of the termination of the drying operation, for example, is connected, and a commercial power supply zero crossing signal detecting circuit 70 for detecting the zero crossing of the commercial power supply are connected to the microcomputer 60.

Additionally, the outlet temperature sensor 30H, the atmospheric temperature sensor 44L, the motor 21, the heater 19 including a first heater 19*a* and a second heater 19*b*, and a load driving circuit 72 for driving an auto power off (APO) 71 for automatically shutting off the supply of power to the clothes drier after the drying operation is terminated are connected to the microcomputer 60.

Either one of the first heater 19*a* and the second heater 19*b* is energized if "weak" is selected by the heater selecting switch 53, while both the heaters are energized if "strong" is selected.

Figures 6A, 6B:
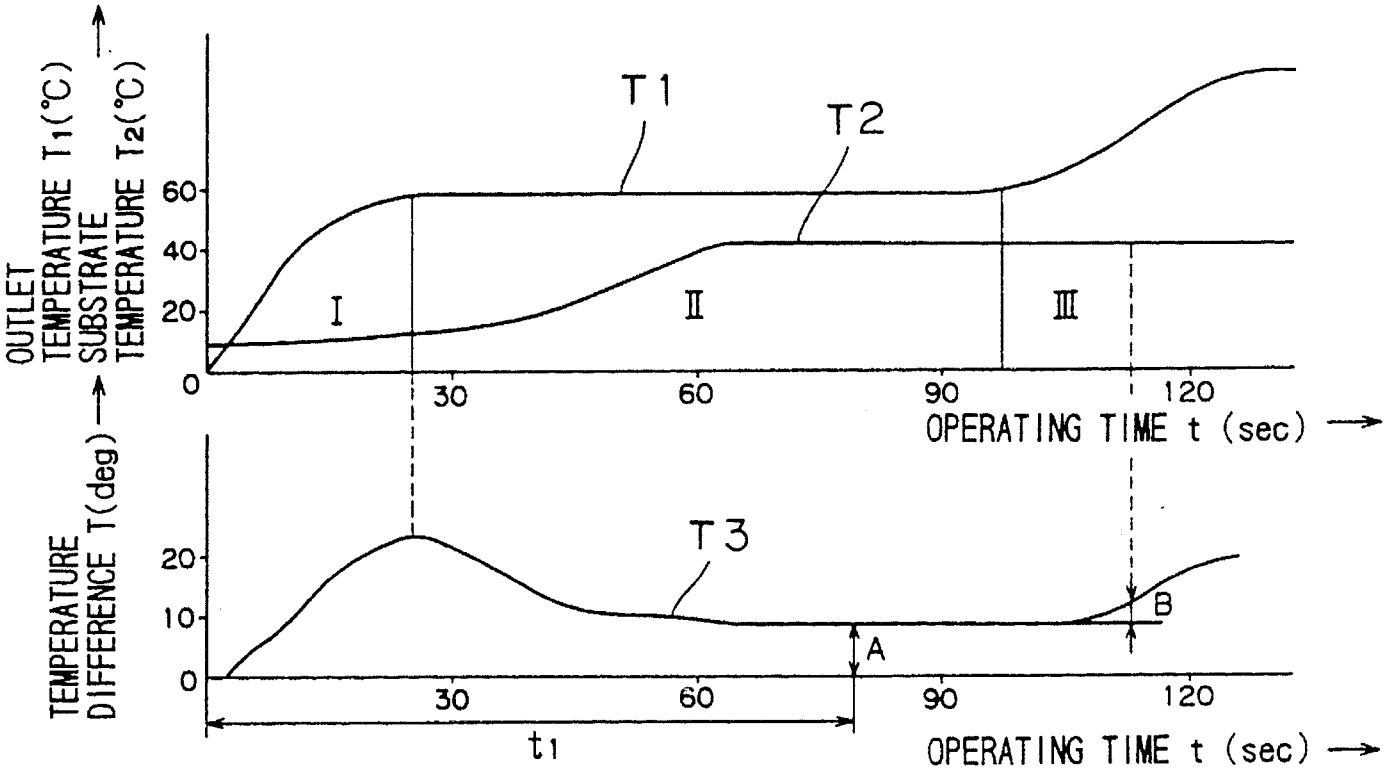
FIG. 6 is a diagram showing the change with time in temperatures respectively detected by two temperature sensors constituting a part of the clothes drier and the change with time in the temperature difference between the above described temperatures.

FIG. 6(*a*) is a diagram showing the change in an outlet temperature T1 detected by the outlet temperature sensor 30H and a substrate temperature T2 detected by the atmospheric temperature sensor 44L with operating time t, and FIG. 6(*b*) is a diagram showing the change in a temperature difference T between the outlet temperature T1 and the substrate temperature T2 (=|T1|- |T2|) with operating time t. FIGS. 6(*a*) and 6(*b*) are obtained when drying processing is actually performed under these conditions: the room temperature: 24° C., clothes contained in the rotating drum 5: a test cloth weighing 3.0 kg in Japanese Industrial Standard (JIS), the drying course: a "standard course", and the degree of heating: "strong" (the coarse for energizing both the first heater 19*a* and the second heater 19*b*).

The outlet temperature T1 changes as a curve T1 in FIG. 6 (*a*). Specifically, in a preheating period I, applied heat is spent so as to increase the temperature of the drier body 1 or clothes themselves containing a large amount of water, whereby the outlet temperature T1 slowly rises. In a constant-rate period of drying II, most of the applied heat is spent so as to vaporize the water in the clothes, whereby the outlet temperature T1 becomes approximately constant. Further, in a falling drying rate period III, the applied heat is spent not only to vaporize the water but also to increase the temperature of the clothes themselves containing a reduced amount of water or the drier body 1, whereby the outlet temperature 1 rises again.

On the other hand, the substrate temperature T2 changes as a curve T2 in FIG. 6(*a*). Specifically, the substrate temperature T2 significantly slowly rises at the beginning, and stably changes if a certain time period has elapsed (approximately 60 minutes in the drawing). The reason for this is that the control substrate 42 is a member having a large thermal capacity which is affected by the ambient temperature itself but is not easily affected by the rapid change in the temperature, as described above, whereby the way the temperature changes depends on radiation of heat of each of electronic components mounted on the control substrate 42.

Therefore, the temperature difference T between the outlet temperature T1 and the substrate temperature T2 changes as a curve T in FIG. 6(*b*). Specifically, the temperature difference T slowly rises at the beginning, slowly decreases after it becomes the highest in the vicinity of a final end of the preheating period I, and then stably changes. The temperature difference T also rises as the outlet temperature T1 in the falling drying rate period III rises.

Although the way the temperature difference T changes is approximately the same even if the room temperature or the like changes, the degree of the temperature difference T differs depending on the room temperature, the degree of heating in the heater 19, the clogging conditions of the lint filter 10, and the like. It is presumed that the reason why the substrate temperature T2 differs depending on the degree of heating in the heater 19 and the clogging conditions of the lint filter 10 is that heated air leaking out to the drying chamber 4 through the felt from the rotating drum 5 slightly affects the detection of the temperature in the atmospheric temperature sensor 44L.

Figure 7:
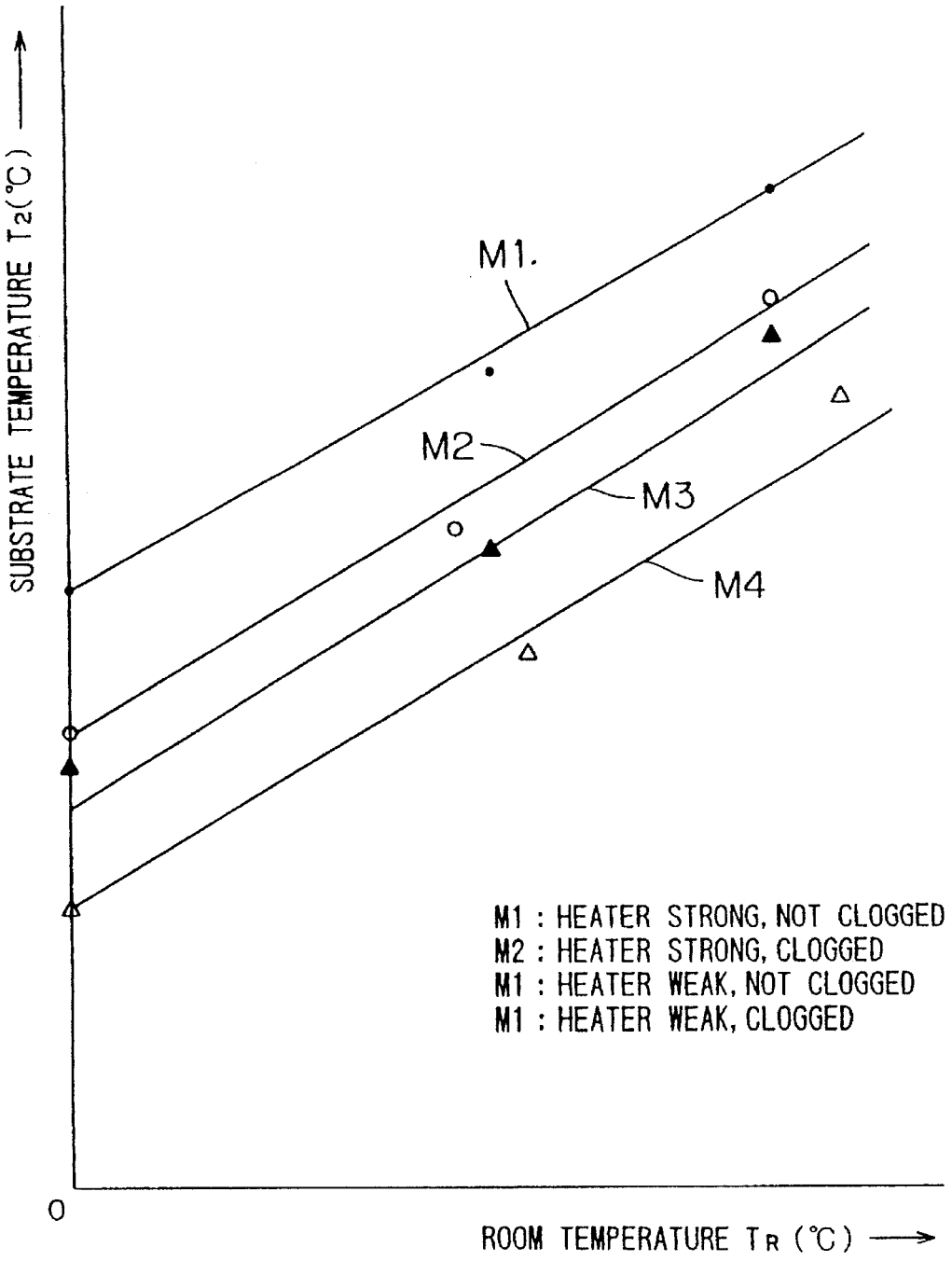
FIG. 7 is a diagram showing the difference in the substrate temperature depending on the room temperature, the degree of heating in a heater, and the clogging conditions of a lint filter.

FIG. 7 is one example of a graph showing the difference in the substrate temperature T2 depending on the room temperature $T_R$, the degree of heating in the heater 19 and the clogging conditions of the lint filter 10. As can be seen from this graph, the relationship between the room temperature $T_R$ and the substrate temperature T2 changes depending on the degree of heating in the heater 19 and the clogging conditions of the lint filter 10. In any case, however, the relationship between the room temperature $T_R$ and the substrate temperature T2 is a simple proportional relationship. Accordingly, there is particularly no problem in determining the termination of the drying processing in the present embodiment.

Figure 8:
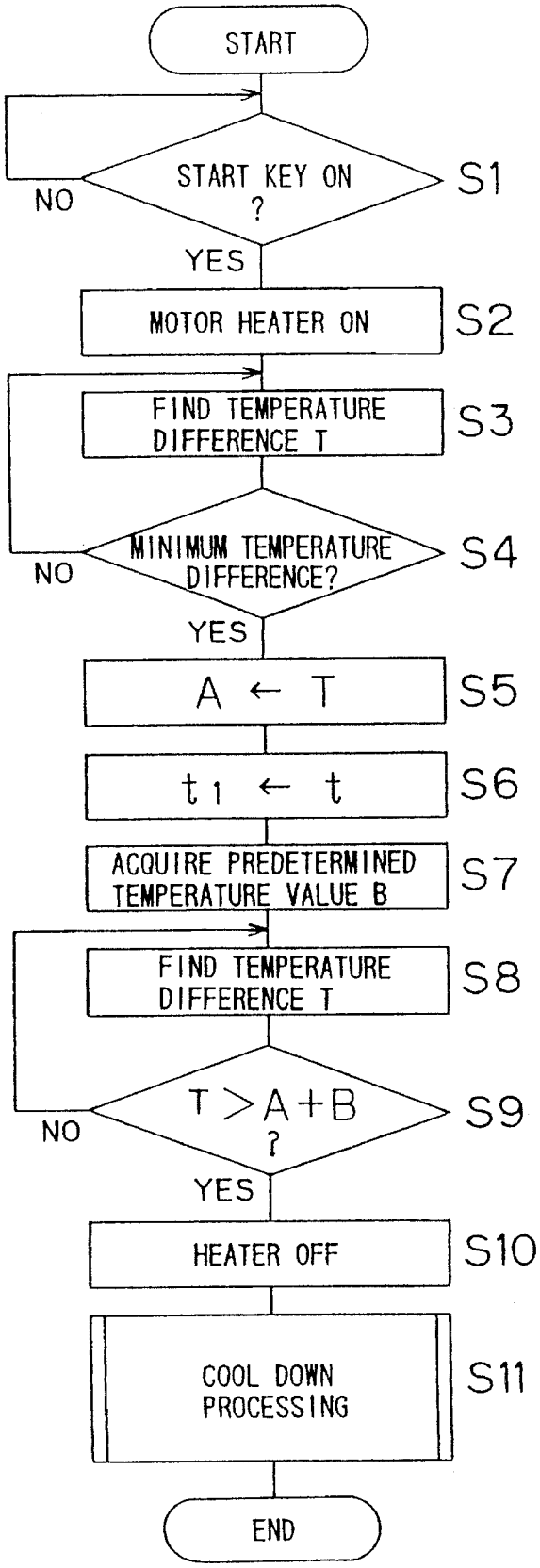
FIG. 8 is a flow chart for explaining operations performed by the clothes drier.
Figure 9A:
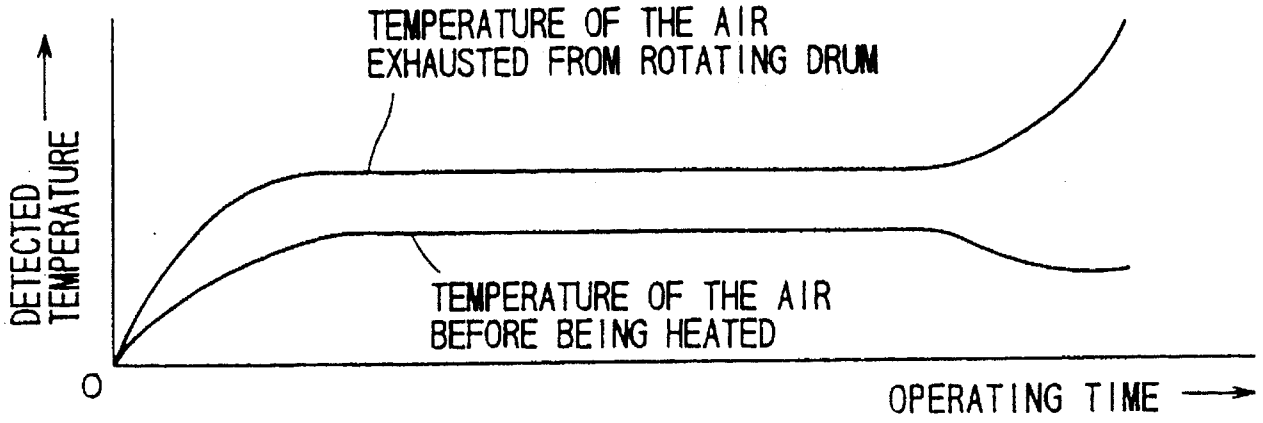
FIGS. 9A and 9B are diagrams showing the change with time in temperatures respectively detected by conventional two temperature sensors and the change with time in the temperature difference between the above described temperatures.
Figure 9B:
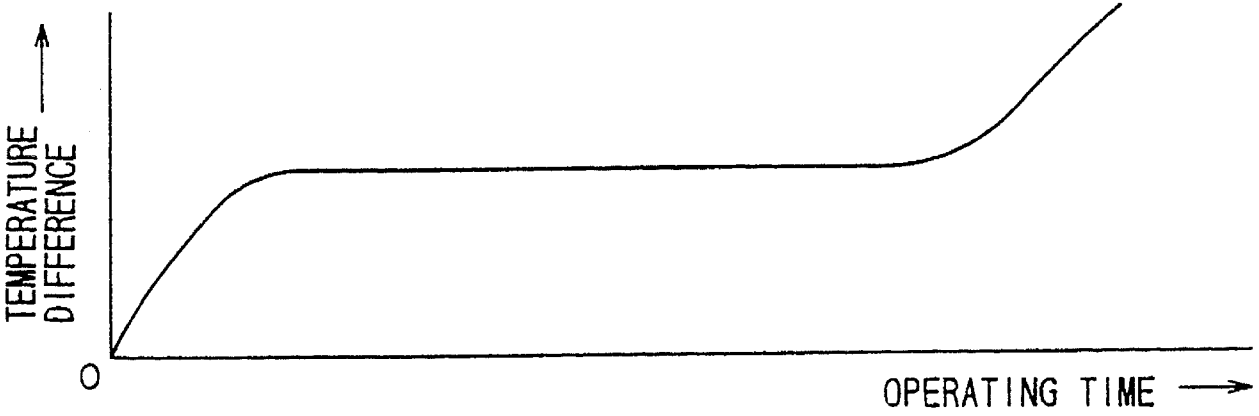

FIG. 8 is a flow chart for specifically explaining the drying operation in the above described clothes drier.

Clothes are contained in the rotating drum 5 by a user, after which the start/pause key 51 is depressed. Consequently, ON of the start/pause key 51 is determined by the microcomputer 60 (step S1). The motor 21 and the heater 19 are energized by the microcomputer 60, and the measurement by a timer in the microcomputer 60 is started to start drying processing (step S2). If the drying processing is started, the outlet temperature T1 detected by the outlet temperature sensor 30H and the substrate temperature T2 detected by the atmospheric temperature sensor 44L are introduced in the microcomputer 60, and the temperature difference T between the outlet temperature T1 and the substrate temperature T2 is found (step S3). The found temperature difference T is stored in the RAM in the microcomputer 60.

It is then determined whether or not the found temperature difference T is the minimum temperature difference (step S4). It is determined depending on whether or not a slope a of the temperature difference T for a very small time Δt (=T/Δt) is the minimum, whether or not the temperature difference T is the minimum temperature difference. It is in the constant-rate period of drying II shown in FIG. 6(*a*) during which the temperature difference T changes almost constantly that the slope a is the minimum. The stable temperature difference T in this period is found as the minimum temperature difference.

The reason why the determination as to whether or not the temperature difference T is the minimum temperature difference is made depending on whether or not the slope a is the minimum is that the continuous operation of the clothes drier is considered. More specifically, when the continuous operation is performed, the substrate temperature T2 of the control substrate 42 has been already a stable temperature. If the operation is performed in this state, therefore, the substrate temperature T2 does not change as the curve T2 in FIG. 6(*a*). That is, the substrate temperature T2 rises to a predetermined value in the preheating time I, and then is always constant. In either case, therefore, the determination is made on the basis of the slope a so that the stable temperature difference T can be found.

If it is determined that the found temperature difference T is the minimum temperature difference as a result of the determination in the foregoing step S4, the found temperature difference T is stored in the RAM in the microcomputer 60 as the minimum temperature difference A (step S5). Simultaneously, the time t elapsed from the start of the drying processing until the temperature difference T stored as the minimum temperature difference A is found and is introduced into the microcomputer 60 from the timer, and this time t is stored as drying processing time $t_1$ in the RAM (step S6).

In the microcomputer 60, if the drying processing time $t_1$ is stored in the RAM, a table stored in the ROM is referred to, whereby a predetermined temperature value B required to determine the termination of the drying processing is acquired (step S7). The following Table 1 shows one example of the above described table.

TABLE 1

| drying processing time | predetermined temperature value B | |
|---|---|---|
| $t_1$ | "strong" | "weak" |
| 30 (min) | 16 (deg) | 7 (deg) |
| 60 (min) | 14 (deg) | 6 (deg) |
| 90 (min) | 12 (deg) | 5 (deg) |
| 120 (min) | 9 (deg) | 4 (deg) |

It is determined that the drying processing is terminated when the temperature difference T rises from the above described minimum temperature difference A by a predetermined temperature value B. The reason for this is that it can be determined that water is thoroughly vaporized from clothes when the temperature difference T rises from the stable temperature by the predetermined temperature value B.

The reason why the above described predetermined temperature value B is changed depending on the drying processing time $t_1$ as shown in Table 1 is that the dried state at the time of the termination of the drying processing differs depending on the amount and the quality of the clothes contained in the rotating drum 5. If the predetermined temperature value B is not changed, that is, the drying processing is terminated when the temperature difference T rises from the above described minimum temperature difference A by an always constant temperature difference, the clothes may not be satisfactorily dried depending on the amount and the quality of the clothes.

The same is true for the degree of heating in the heater 19. Therefore, the predetermined temperature value B is changed depending on the degree of heating in the heater 19 (which is represented by "strong" and "weak" in Table 1).

If the predetermined temperature value B is acquired, the temperature difference T is then found (step S8), and it is determined whether or not the found temperature difference T is larger than (A+B) (step S9). If it is determined that the temperature difference T is larger than (A+B), the energization to the heater 19 is stopped step S10), and the energization to the motor 21 is continued, whereby so-called cool down processing is performed over a predetermined time period or until the outlet temperature T1 detected by the outlet temperature sensor 30H reaches not more than a predetermined temperature $T_0$ (for example, $T_0$=40° C.) (step S11).

If the cool down processing is terminated, the drying operation in the clothes drier is terminated.

As described in the foregoing, according to the clothes drier in the present embodiment, the atmospheric temperature sensor 44L required to determine the termination of the drying processing is provided in the substrate case 40 outside the circulating duct 18 with it being covered with the cover 45, whereby the atmospheric temperature sensor 44L is significantly less affected by dust, water, heated air leaking out and the like. Therefore, defects occurring by failures and changes with years in the atmospheric temperature sensor 44L due to the effect of dust and water can be minimized, as compared with a case where the atmospheric temperature sensor 44L is disposed inside the circulating duct 18. Therefore, it is possible to stably determine the termination of the drying processing.

Furthermore, the atmospheric temperature sensor 44L and the microcomputer 60 are mounted on the same control substrate 42, thereby to make it possible to significantly reduce the length of a signal line to connect the atmospheric temperature sensor 44L and the microcomputer 60 as well as significantly simplify wiring work. Therefore, it is possible to reduce the cost.

Additionally, the atmospheric temperature sensor 44L detects the temperature of the control substrate 42 having a large thermal capacity, thereby to make it possible to satisfactorily determine the termination of the drying processing irrespective of the environment.

Although the present invention has been described and illustrated in detail, the present invention is not limited to the above described embodiment. Although in the above described embodiment, clothes are taken as an example of objects to be dried, the present invention is also applicable to objects to be dried other than the clothes, for example, blankets and sheets.

Furthermore, although in the above described embodiment, description was made of a case where the atmospheric temperature sensor 44L is mounted on the control substrate 42 on which the microcomputer 60 is provided, the atmospheric temperature sensor 44L may be mounted on a frame of the drier body 1, for example, to detect the temperature of the frame. The reason for this is that the frame is composed of a good thermal conductor such as a metal and the shape thereof is large, so that the thermal capacity thereof is large. Specifically, the atmospheric temperature sensor 44L maybe provided outside the circulating duct 18 and in the position where a member having a large thermal capacity which is not easily affected by the ambient temperature can be detected, to detect the temperature of the member having a large thermal capacity.

It is clearly understood that the same is by way of illustration and example only and is not to be taken by way of limitation, the spirit and scope of the present invention being limited only by the terms of the appended claims.

EFFECTS OR ADVANTAGES OF THE INVENTION

As described in the foregoing, according to the clothes drier in the present invention, the second temperature detecting means used for determining the termination of the drying processing is provided outside the circulating air duct means and in the position where the temperature of the member having a large thermal capacity can be detected, thereby to make it possible to minimize failures in the second temperature detecting means due to the effect of water and dust as well as significantly delaying the time in which defects by changes with years in the second temperature detecting means occur, as compared with a case where it is provided inside the circulating air duct means which is greatly affected by water and dust. Therefore, the termination of the drying processing can be stably determined, thereby to make it possible to realize good drying over a relatively long time period.

Furthermore, the second temperature detecting means detects the temperature of the member having a large thermal capacity, thereby to make it possible to satisfactorily determine the termination of the drying processing irrespective of the environment.

Particularly if the second temperature detecting means and the determining means are mounted on the same control substrate, it is possible to reduce the signal line to connect the second temperature detecting means and the determining means as well as simplify the wiring work. Therefore, it is possible to reduce the cost, as compared with that in the conventional example.

Furthermore, the temperature difference which forms a basis required to judge the termination of the drying processing can be always stably found, thereby to make it possible to accurately determine the termination of the drying processing.

Additionally, it is possible to further minimize failures in the second temperature detecting means.

What is claimed is:

1. A clothes drier comprising:

a rotating drum comprising an air inlet and an air outlet for containing clothes;

circulating air duct means having its one end connected to the air outlet in the rotating drum and the other end connected to the air inlet in said rotating drum;

heating means provided in said circulating air duct means for heating air to provide heated air;

air blower means for circulating the heated air provided by said heating means in said circulating air duct means and said rotating drum;

dehumidifying means for dehumidifying the heated air when it goes out of said rotating drum and goes through said circulating air duct means;

a control substrate having a large thermal capacity;

first temperature detecting means for detecting the temperature of the heated air exhausted from said rotating drum;

second temperature detecting means provided outside said circulating air duct means and disposed on said control substrate for detecting the temperature of said control substrate; and determining means disposed on said control substrate for determining whether or not drying processing is terminated on the basis of the temperature difference between temperatures respectively detected by said first temperature detecting means and said second temperature detecting means.

2. The clothes drier according to claim 1, wherein said air blower means includes an air-exchange type air blower means which combines a function of said dehumidifying means.

3. The clothes drier according to claim 1, further comprising;

judging means for judging whether or not the change with time in the temperature difference between the temperatures respectively detected by said first temperature detecting means and said second temperature detecting means is the minimum, and said determining means determining that the drying processing is terminated when said temperature difference reaches a value obtained by adding a predetermined temperature to a temperature difference in a case where said judging means judges that the change with time in the temperature difference is the minimum.

4. The clothes drier according to claim 1 wherein said second temperature detecting means is sealed by a predetermined cover.

5. The clothes drier according to claim 4, wherein said predetermined cover includes a urethane coat on an upper surface of said control substrate.

6. The clothes drier according to claim 4, wherein said control substrate is attached behind a control plate, and said predetermined cover includes a cover integrally formed with said control plate.

* * * * *